US009032449B2

(12) United States Patent
Bajgrowicz

(10) Patent No.: US 9,032,449 B2
(45) Date of Patent: May 12, 2015

(54) ALGORITHM FOR IMPROVING TRANSPONDER SCANNING IN A SATELLITE SET-TOP BOX

(75) Inventor: Brian David Bajgrowicz, Marion, IN (US)

(73) Assignee: Thomson Licensing, Issy les Moulineaux (FR)

( * ) Notice: Subject to any disclaimer, the term of this patent is extended or adjusted under 35 U.S.C. 154(b) by 0 days.

(21) Appl. No.: 13/505,820

(22) PCT Filed: Nov. 13, 2009

(86) PCT No.: PCT/US2009/006129

§ 371 (c)(1),
(2), (4) Date: May 3, 2012

(87) PCT Pub. No.: WO2011/059422

PCT Pub. Date: May 19, 2011

(65) Prior Publication Data

US 2012/0246688 A1 Sep. 27, 2012

(51) Int. Cl.
*H04H 40/90* (2008.01)

(52) U.S. Cl.
CPC ..... *H04H 40/90* (2013.01)

(58) Field of Classification Search
USPC ..... 725/68, 70–72, 140, 152; 375/235, 319, 375/327, 343–344, 350, 364; 455/307, 337; 348/725–726
See application file for complete search history.

(56) References Cited

U.S. PATENT DOCUMENTS

| | | | | |
|---|---|---|---|---|
| 5,507,025 | A | 4/1996 | Rodeffer | |
| 6,192,071 | B1 | 2/2001 | Hirth et al. | |
| 2010/0172446 | A1* | 7/2010 | Popoli | 375/340 |

FOREIGN PATENT DOCUMENTS

| | | |
|---|---|---|
| CN | 1761302 | 4/2006 |
| EP | 0627830 | 4/1996 |
| EP | 1689077 | 8/2006 |
| GB | 2138640 | 10/1984 |
| JP | 2007158493 | 6/2007 |
| KR | 20000008677 | 2/2000 |
| WO | WO2007047376 | 4/2007 |
| WO | WO2007133190 | 11/2007 |

OTHER PUBLICATIONS

Search Rept: Feb. 19, 2010.

* cited by examiner

*Primary Examiner* — Jason Salce
(74) *Attorney, Agent, or Firm* — Robert D. Shedd; Kuniyuki Akiyama

(57) ABSTRACT

The present invention concerns a method and associated apparatus for reducing the time required to scan an incoming satellite transmission power spectrum for available signals and to determine the characteristics of those signals. The frequency range of interest is scanned in narrow slices to determine approximate input power within each slice. Center frequencies and symbol rates of individual transponders are then estimated based upon these input power approximations.

9 Claims, 4 Drawing Sheets

ALGORITHM FOR IMPROVING TRANSPONDER SCANNING IN A SATELLITE SET-TOP BOX

This application claims the benefit, under 35 U.S.C. §365 of International Application PCT/US2009/006129, filed Nov. 13, 2009, which was published in accordance with PCT Article 21(2) on May 19, 2011 in English.

BACKGROUND OF THE INVENTION

The present invention generally relates to a method and associated apparatus for reducing the time required to scan an incoming satellite transmission power spectrum for available signals and to determine the characteristics of those signals. The frequency range of interest is scanned in narrow slices to determine approximate input power within each slice. Center frequencies and symbol rates of individual transponders are then estimated based upon these input power approximations.

This section is intended to introduce the reader to various aspects of art, which may be related to various aspects of the present invention that are described below. This discussion is believed to be helpful in providing the reader with background information to facilitate a better understanding of the various aspects of the present invention. Accordingly, it should be understood that these statements are to be read in this light, and not as admissions of prior art.

Satellite television receiving systems generally comprise an outdoor unit, comprising a dish antenna and a low noise block (LNB) amplifier, and an indoor unit, commonly referred to as an integrated receiver decoder (IRD), which may be in the form of a set-top box. The set-top box generally comprises at least one tuner and a signal processing section, and is used to tune desired television signals.

In some environments, the set-top box can be pre-programmed with certain information regarding the signals to be received, such as possible center frequencies, bandwidths, and symbol rates. In other cases, it is necessary for a set-top box to scan the input signals for channels and their configurations.

Scanning to determine the input configuration is commonly performed using a brute force method. In one such method, the tuner is tuned to a frequency near the low end of the input frequency spectrum, a symbol rate is chosen, and an attempt is made to lock a signal. If a signal cannot be locked, the symbol rate is changed and another attempt is made. After some number of changes in the symbol rate, the frequency is then increased by some interval to the next potential channel frequency and the process is repeated.

In transmission environments with a wide range of frequencies and varying signal parameters, such as a satellite television system with hundreds of potential channels spanning Ka and Ku bands, however, this approach can be extremely time consuming. Many hours may be required for a full scan, which can be required at initial device activation, significantly delaying use of the device by the consumer.

As satellite capacity is added and greater variations in transmission parameters are allowed, the time required increases even further, becoming unacceptable to the user. A method is therefore needed to improve the satellite set-top box scanning process. The invention described herein addresses this and/or other problems.

SUMMARY OF THE INVENTION

In order to solve the problems described above, the present invention concerns a method and associated apparatus for reducing the time required to scan an incoming satellite transmission power spectrum for available signals and to determine the characteristics of those signals. The frequency range of interest is scanned in narrow slices to determine approximate input power within each slice. Center frequencies and symbol rates of individual transponders are then estimated based upon these input power approximations. This and other aspects of the invention will be described in detail with reference to the accompanying Drawings.

BRIEF DESCRIPTION OF THE DRAWINGS

The above-mentioned and other features and advantages of this invention, and the manner of attaining them, will become more apparent, and the invention will be better understood, by reference to the following description of embodiments of the invention taken in conjunction with the accompanying drawings, wherein.

The exemplifications set out herein illustrate preferred embodiments of the invention, and such exemplifications are not to be construed as limiting the scope of the invention in any manner.

DESCRIPTION OF THE PREFERRED EMBODIMENTS

As described herein, the present invention provides a method and associated apparatus for reducing the time required to scan an incoming satellite transmission power spectrum for available signals and to determine the characteristics of those signals. The frequency range of interest is scanned in narrow slices to determine approximate input power within each slice. Center frequencies and symbol rates of individual transponders are then estimated based upon these input power approximations.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The present invention may be implemented in a set-top box or video decoder that is capable of receiving satellite signals or other transmitted television signals. Such a system usually receives signals from a variety of transponders or transmitters, tuning those signals that are of interest at a particular time. The signals may comprise encoded packets of data representing video and audio information in compressed form. The signals are encoded such that a video signal can be generated and viewed upon being decoded at the proper frequency, bandwidth, and symbol rate.

Figure 1:
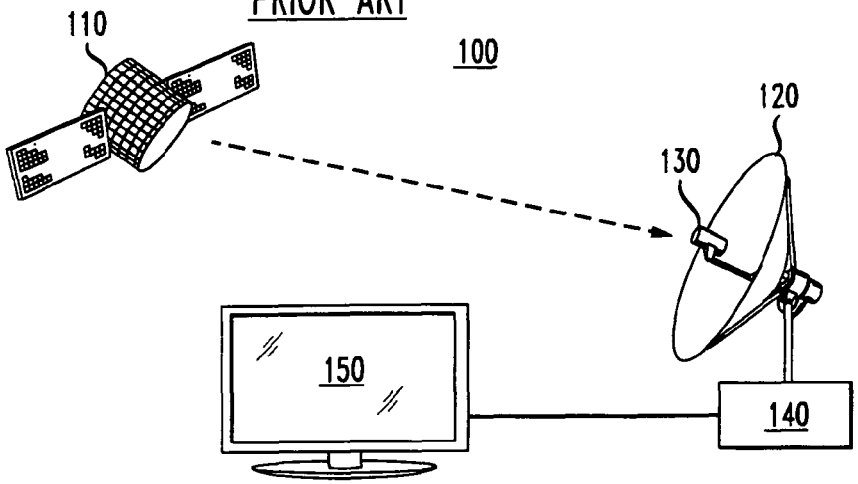
FIG. 1 PRIOR ART
FIG. 1 is a diagram of an exemplary embodiment of a satellite television system.

FIG. 1 is a diagram of an exemplary embodiment of a satellite television system. FIG. 1 shows a transmitting satellite 110, a parabolic dish antenna 120 with a low noise block 130, a digital satellite set-top box 140 and a display 150.

The satellite television system operates to broadcast microwave signals to a wide broadcast area by transmitting the signals from a geosynchronous satellite 110. A geosynchronous satellite 110 orbits the earth once each day at approximately 35,786 kilometers above the surface of the Earth. Such broadcast satellites 110 generally orbit around the equator and remain in the same position with respect to positions on the ground, allowing a satellite receiving antenna 120 to maintain a fixed look angle.

A transmitting satellite 110 receives signals from uplink transmitters and then rebroadcasts the signals back to earth using a set of transponders utilizing a variety of transmission frequencies. The altitude of the transmitting satellite 110 allows subscribers in a wide geographical area to receive the signal. However, the distance from the earth and the severe power conservation requirements of the satellite also result in a relatively weak signal being received at the antenna 120. It is therefore critical that the signal be amplified as soon as possible after it is received by the antenna. This requirement is achieved through the placement of a low noise block (LNB) 130 downconverter amplifier at the feed horn of the parabolic dish antenna 120.

Figure 2P:
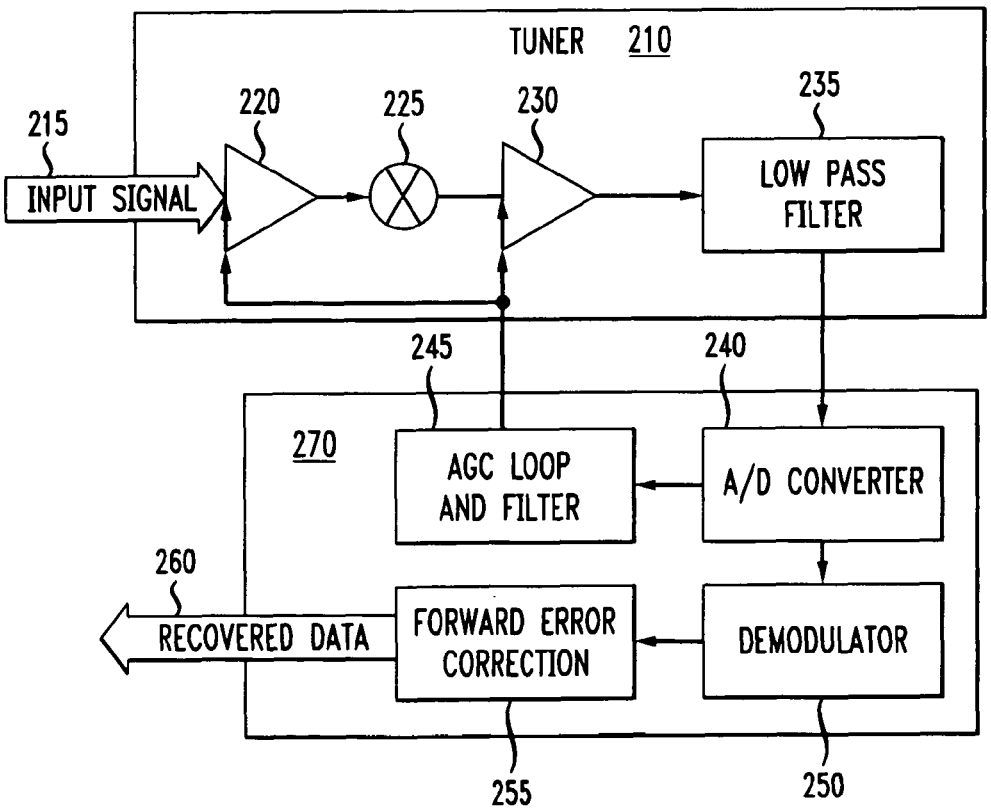
FIG. 2P PRIOR ART
FIG. 2 is a block diagram of an exemplary satellite set-top box front end configuration.

FIG. 2 is a block diagram of reception circuitry of a satellite set-top box. An input signal 215 is received and processed through amplification 220, 230, mixing 225, and low pass filtering circuitry 235. The low pass filtered signal from low pass filter 235 is then converted from analog to digital by A/D converter 240. The digital signal from A/D converter 240 is provided to demodulator 250 for demodulation and to the AGC loop and filter circuitry 245 for use in automatic gain control. Output of the AGC loop and filter circuitry is provided to amplifiers 220 and 230. Forward error correction circuitry 255 accepts input from demodulator 250 and produces recovered data 260. The functions described may be performed by a combination of dedicated hardware, general purpose signal processing hardware, or software.

Figure 3:
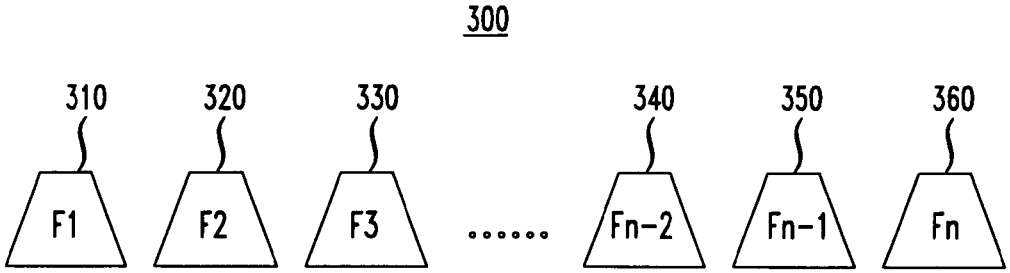
FIG. 3 PRIOR ART
FIG. 3 is a block diagram of an exemplary satellite transmission power spectrum.

FIG. 3 is a simplified block diagram of an incoming power spectrum received at a satellite receiving antenna 120. The exemplary incoming spectrum is illustrated with signal power distributions 310, 320, 330, 340, 350, and 360 transmitted from a set of n transponders with center transmission frequencies F1, F3, F3 . . . FN. While the simplified figure illustrates consistent and smooth power distributions, the incoming spectrum may consist of signals from various transponders of the same or different bandwidths, power levels, noise levels, and symbol rates.

To make use of the incoming signals, a receiving unit must know or learn the frequencies, bandwidths, and symbol rates of the transponder transmissions, all of which may vary. The symbol rate of a particular transponder, for instance, may depend upon the data rate, forward error correction rates (e.g., Viterbi or Reed-Solomon), and the modulation factor (i.e., bits per symbol).

In some reception environments, the channel center frequencies are well known, or fit one of a small number of known patterns. In such environments, scanning for signals can be performed by tuning to each known center frequency, detecting whether a signal is present, and possibly determining a symbol rate or other parameters if they are unknown. However, if the transmission scheme is unknown, if a set-top box is to be used in a variety of environments, or if the set top box is to be used in an environment that changes over time, the ability to determine the frequencies, bandwidths, and symbol rates of incoming signals is desirable. Such may be the case for a set-top box developed for use with multiple satellite programming providers, or for use with different satellites or transponder configurations over time.

A brute force evaluation of all possible combinations of center frequencies, bandwidths, and symbol rates can be overly time-consuming and impractical. To avoid the need for such a scan, the incoming power spectrum can instead be analyzed in segments to determine the distribution of power. The power distribution can then be used to derive information regarding center frequencies, bandwidths, and symbol rates.

Figure 4:
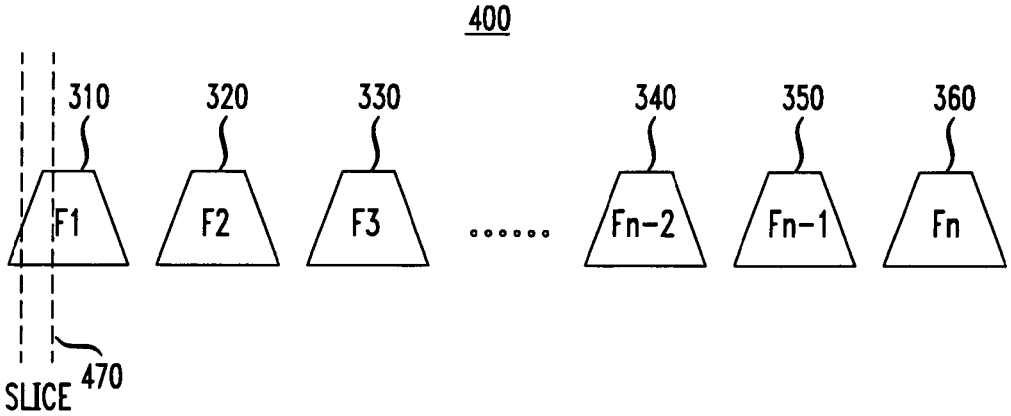
FIG. 4 is a block diagram of an exemplary slice of an incoming satellite transmission power spectrum.

FIG. 4 illustrates the extent of an exemplary "slice" or frequency band 470 of the incoming power spectrum. In some embodiments, the width of the frequency band will be narrow relative to the expected bandwidth of the transmission from a single transponder or transmitter. The width and spacing of the evaluated slices may be varied based upon factors such as the level of prior knowledge regarding the transmission environment and performance requirements.

Figure 5:
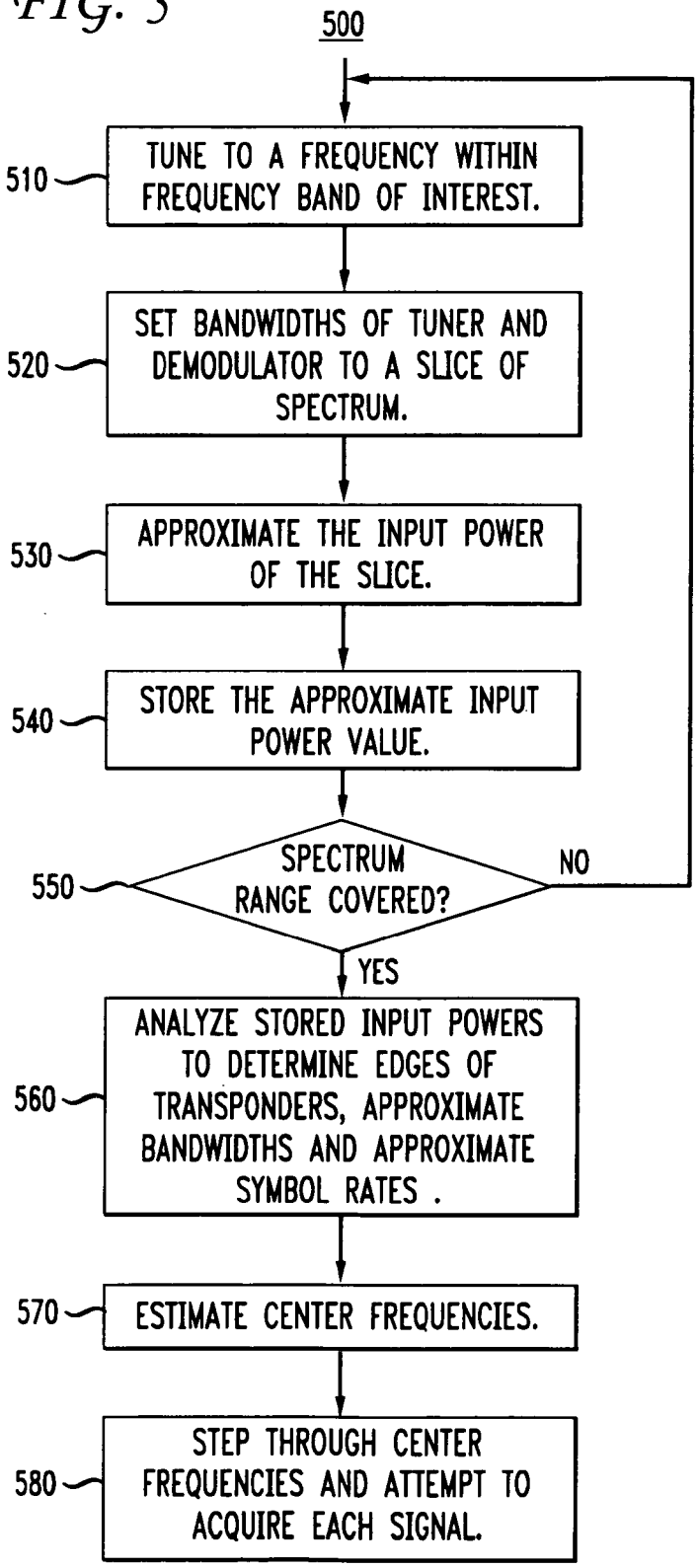
FIG. 5 is a flow chart of a method to determine the center frequencies and symbol rates of signals from multiple transponders.

An algorithm such as the one illustrated in FIG. 5 can be used to evaluate the received power spectrum and narrow down the number of frequencies and symbol rates that need to be searched, thus speeding the overall scanning process. At step 510, the tuner is set to a frequency within the portion of the spectrum expected to contain signals to be discovered. For instance, for a satellite television set-top box, this may be a frequency at the low end of the Ka or Ku satellite bands. In one embodiment, at the first iteration of step 510, an initial frequency at the lower end of the spectrum of interest would be chosen. Subsequent frequency settings at later iterations of step 510 may be made at increments equal to the bandwidth of the slice, or in narrower or wider increments. Frequencies may also be selected in a non-sequential manner.

At step 520, the bandwidths of the tuner and demodulator are set such that a "slice" or narrow band 470 of the spectrum is being tuned and analyzed. In some embodiments, this step may not be required for every iteration. In other embodiments, the bandwidths may be preset and not require explicit setting at all.

At step 530, the input power of the selected spectrum slice is approximated. This approximation may be performed using one or more of multiple AGC loops in the receiving system. The approximation may be performed using the RF loop, shown in FIG. 2, or could be performed after an anti-aliasing filter in the demodulator and its AGC circuit using a narrow bandwidth. Power approximation may also be performed using other signal processing hardware or software.

At step 540, the approximated input power for the slice is stored in a memory. The memory may comprise buffers or registers within the reception hardware, general purpose RAM associated with the processing hardware, or other storage.

If at decision point 550, the spectrum of interest has not yet been covered, the algorithm returns to step 510, a new center frequency is set, and the input power for the next slice is approximated 530 and stored 540. In some embodiments, an explicit decision may not be made. For instance, if the range and spacing of slices is predetermined, the algorithm may simply iteratively perform the approximations.

When the frequency range of interest has been covered, the algorithm proceeds to step 560 where the stored input power estimates are analyzed to determine the frequency edges of the various transponders and their approximate bandwidths and symbol rates. The edge detection may be performed by locating a peak-to-null difference, through analysis of the slope of the approximated power values, or through other analysis techniques. In some embodiments, if bandwidths and symbol rates are known in advance, only the locations of center frequencies may be needed and step 560 may be omitted.

At step 570, center frequencies are estimated for the various transponders. A window averaging algorithm may be applied to the table of approximated powers over some bandwidth based upon the symbol rate approximations from step 560, based upon a maximum supported symbol rate, or based upon a factor of the acquisition bandwidth and the range of symbol rates supported. The location of a peak output from the window averaging can be used as an estimate of the center frequency of a particular signal. The estimated edge frequencies from step 560 may also be used to determine the location of center frequencies. For instance, the average of the low and high frequency edges of a power distribution may be used as an estimate for the associated center frequency. In some embodiments, determination of center frequencies may be performed before estimation of edge locations and bandwidths.

With the center frequencies of the transponders and symbol rates roughly known, at step 580, the receiving system may step through the center frequencies and attempt to acquire each signal. In general, the number of center frequencies to be tested will be significantly smaller than the number of possible frequencies, thus reducing the time required for the scan relative to a brute force approach. Various symbol rates might need to be tried depending on the accuracy at which the data was obtained or on the pull-in range of the demodulator. Parameters of those signals which are successfully tuned may be stored in a channel table in a memory of the set-top box for later use.

The accuracy of the input power estimates can be controlled with a few parameters, including the bandwidth of the slice and the loop bandwidth of the AGC detector in the tuner/demodulator circuit. Tradeoffs exist, however, between speed and accuracy. The use of narrow slices can provide a more accurate power estimate, but requires the estimation of power over a greater number of slices to cover the complete bandwidth of interest, thereby requiring more time. However, narrower slices will more accurately locate narrow gaps in the spectrum between transponders and the center frequencies of transponders. Variations in slope in the gain of the front end components of the tuner or demodulator, spurs, and the initial accuracy of the AGC to input power conversion, will also have an effect on accuracy and must be accounted for in the calculation of center frequency and symbol rates.

A related approach can be used in the setting of AGC levels. In the absence of intermodulation effects, narrow-band power detection within a channel of interest can be effectively used to set AGC levels. However, in the presence of intermodulation effects, power from adjacent channels may cause the selection of inappropriate gain levels by the AGC or even saturation of amplifiers within the system. Thus, it may be necessary to set parameters such as AGC control levels, gain settings, and attenuator settings in a set-top box RF front end based upon wideband aggregate input power rather than upon a single narrow band input signal.

Wideband power detection and determination of gain settings is commonly performed with a diode detector circuit or similar hardware functionality. This method, although effective, adds the cost and complexity of the circuitry of the set-top box. To reduce cost and complexity, a software algorithm can be used to emulate a wideband power detector circuit in a set-top box in order to estimate the aggregate input power. Information about the overall power distribution and aggregate power can then be used to set AGC at a more appropriate level than could be achieved with a narrow band power estimation.

Figure 6:
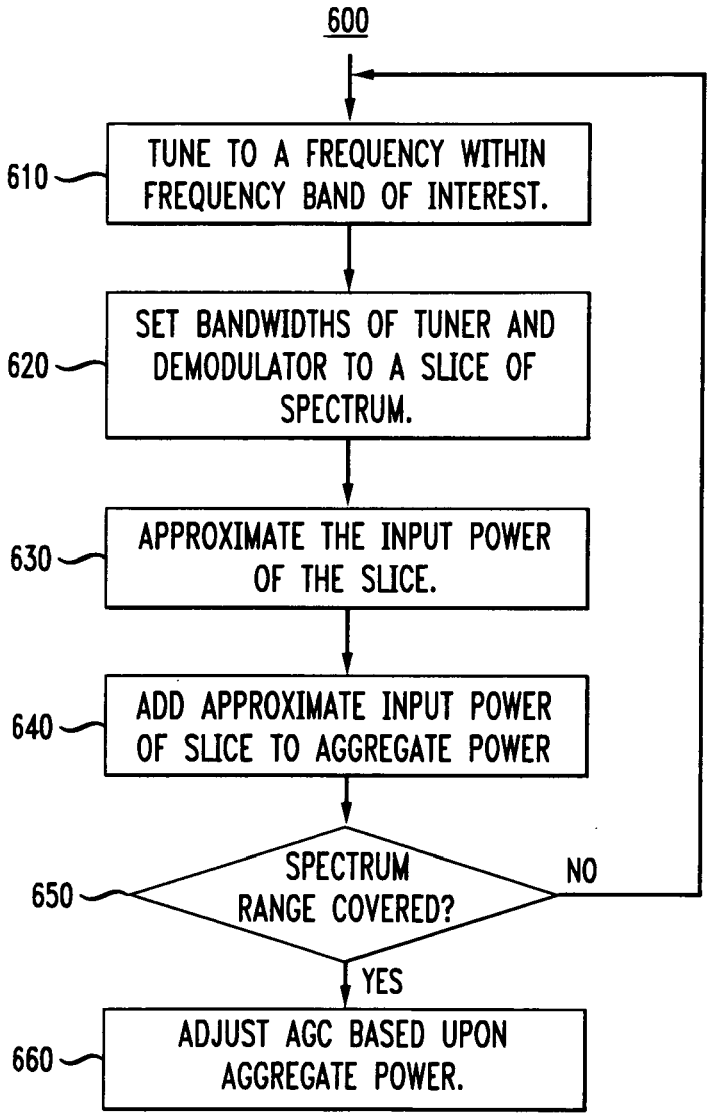
FIG. 6 is a flow chart of a method to approximate the aggregate input power of a set of signals from a set of transponders.

If one knows the center frequencies and bandwidths of each transponder, the system could be tuned to each transponder, a power estimate could be generated, and the estimates could be summed to create an estimate of aggregate input power. If one does not know such information, the algorithm illustrated in FIG. 6 can be used to compute aggregate power across a frequency range and use the aggregate power for AGC adjustment.

At step 610, the tuner is set to a frequency within the portion of the spectrum expected to contain signals to be discovered. In one embodiment, at the first iteration of step 610, an initial frequency at the lower end of the portion of the spectrum of interest would be chosen. Subsequent frequency settings at later iterations of step 610 may be made at increments equal to the bandwidth of the slice, or in narrower or wider increments. Frequencies may also be selected in a non-sequential manner.

At step 620, the bandwidths of the tuner and demodulator are set such that a "slice," or narrow band 470 of the spectrum is being tuned analyzed. In some embodiments, this step may not be required for every iteration. In some embodiments, the bandwidths may be preset and not require explicit setting at all.

At step 630, the input power of the selected slice is approximated. This approximation may be performed using one or more of multiple AGC loops in the receiving system. The approximation may be performed using the RF loop, shown in FIG. 2, or could be performed after an antialiasing filter in the demodulator and its AGC circuit using a narrow bandwidth. Power approximation may also be performed using other signal processing hardware or software.

At step 640, the approximated input power for the slice is added to a total power value. At the first iteration of step 640, the aggregate power value may be set to zero before the approximated power of the first slice is added. The aggregate power value may be stored in a memory, which may comprise buffers or registers within the reception hardware, general purpose RAM associated with the processing hardware, or other storage.

If at decision point 650, the spectrum of interest has not yet been covered, the algorithm returns to step 610 and the input power for the next slice is approximated 630 and stored 640.

When the frequency range of interest has been covered, the algorithm proceeds to step 660 where the aggregate power value is then used as a basis to adjust AGC or other reception parameters. Various AGC parameters or other functions may be adjusted based on the calculated aggregate power. For instance, the system may change crossover points for various gain stages, or engage a switchable attenuator if a determination is made that the measured signal would saturate an amplifier.

As with the channel scanning algorithm of FIG. 5, the accuracy of the input power estimate of a transponder or slice can be controlled with a few parameters, including the bandwidth of the slice and the loop bandwidth of the AGC detector in the tuner/demodulator circuit. Tradeoffs exist, however, between speed and accuracy. The use of narrow slices can provide a more accurate power estimate, but requires the estimation of power over a greater number of slices to cover the complete bandwidth of interest, thereby requiring more time.

While the present invention has been described in terms of a specific embodiment, it will be appreciated that modifications may be made which will fall within the scope of the invention. For example, various processing steps may be implemented separately or combined, and may be implemented in general purpose or dedicated data processing hardware or in software.

The invention claimed is:

1. A method comprising:

receiving a satellite transmission power spectrum including a plurality of signal power distributions transmitted from a respectively plurality of transponders;

tuning to an end of said spectrum;

setting a slice of said spectrum as a band of tuning frequencies, a bandwidth of said slice being narrower than a bandwidth of one of said plurality of signal power distributions;

determining an approximate power value of each one of said slices by measuring a level of AGC signal throughout said spectrum toward an opposite end of said spectrum at a predetermined increment, said AGC signal being used for controlling a gain of an amplifier receiving said spectrum;

storing said approximate power value of said each one of said slices in a memory;

determining a total value of signal power within said spectrum by aggregating said approximate power value of said each one of said slices;

adjusting said AGC level in response to said total value of signal power;

determining approximate edges of said signal power distribution transmitted from one of said plurality of transponders for estimating an approximate bandwidth of said power distribution and an approximate center frequency of said signal power distribution from said approximate power value of said each one of said slices stored in said memory;

determining an approximate symbol rate of said transponder from said approximate power value of said each one of said slices stored in said memory; and attempting to acquire an available signal in the vicinity of said approximate center frequency.

2. The method of claim 1, wherein:

said predetermined increment narrower than said bandwidth of said slice.

3. The method of claim 1, wherein:

said predetermined increment is wider than said bandwidth of said slice.

4. An apparatus comprising:

a tuner including an amplifier for receiving a satellite transmission power spectrum including a plurality of signal power distributions transmitted from a respectively plurality of transponders, and a signal processor performing the steps of:

tuning said tuner to an end of said spectrum;

setting a slice of said spectrum as a band of tuning frequencies for said tuner, a bandwidth of said slice being narrower than a bandwidth of one of said plurality of signal power distributions;

determining an approximate power value of each one of said slices by measuring a level of AGC signal throughout said spectrum toward an opposite end of said spectrum at a predetermined increment, said AGC signal being used for controlling a gain of said amplifier in said tuner;

storing said approximate power value of said each one of said slices in a memory;

determining a total value of signal power within said spectrum by aggregating said approximate power value of said each one of said slices;

adjusting said AGC level in response to said total value of signal power;

determining approximate edges of said signal power distribution transmitted from one of said plurality of transponders for estimating an approximate bandwidth of said power distribution and an approximate center frequency of said signal power distribution from said approximate power value of said each one of said slices stored in said memory;

determining an approximate symbol rate of said transponder from said approximate power value of said each one of said slices stored in said memory; and causing said tuner to acquire an available signal in the vicinity of said approximate center frequency.

5. The apparatus of claim 4, wherein:

said predetermined increment is narrower than said bandwidth of said slice.

6. The apparatus of claim 4, wherein:

said predetermined increment is wider than said bandwidth of said slice.

7. An apparatus comprising:

first means for receiving a satellite transmission power spectrum including a plurality of signal power distributions transmitted from a respectively plurality of transponders;

second means for performing the steps of:

tuning said first means to an end of said spectrum;

setting a slice of said spectrum as a band of tuning frequencies for said first means, a bandwidth of said slice being narrower than a bandwidth one of said plurality of signal power distributions;

determining an approximate power value of each one of said slices by measuring a level of AGC signal throughout said spectrum toward an opposite end of said spectrum at a predetermined increment, said AGC signal being used for controlling a gain of said first means;

storing said approximate power value of said each one of said slices in a memory;

determining a total value of signal power within said spectrum by aggregating said approximate power value of said each one of said slices;

adjusting said AGC level in response to said total value of signal power;

determining approximate edges of said signal power distribution transmitted from one of said plurality of transponders for estimating an approximate bandwidth of said power distribution and an approximate center frequency of said signal power distribution from said approximate power value of said each one of said slices stored in said memory;

determining an approximate symbol rate of said transponder from said approximate power value of said each one of said slices stored in said memory; and causing said first means to acquire an available signal in the vicinity of said approximate center frequency.

8. The apparatus of claim 7, wherein:

said predetermined increment is narrower than said bandwidth of said slice.

9. The apparatus of claim 7, wherein:

said predetermined increment is wider than said bandwidth of said slice.

* * * * *